US006067912A

United States Patent [19]

Miller

[11] Patent Number: 6,067,912

[45] Date of Patent: May 30, 2000

[54] AUTOMATED DISCHARGE SYSTEM FOR HOPPER CAR

[75] Inventor: Daniel L. Miller, Fountain, Mich.

[73] Assignee: TRN Business Trust, Dallas, Tex.

[21] Appl. No.: 08/936,151

[22] Filed: Sep. 22, 1997

[51] Int. Cl.[7] ..... B61D 7/30

[52] U.S. Cl. ..... 105/283; 105/280; 105/286; 105/240

[58] Field of Search ..... 105/280, 283, 105/284, 286, 308.1, 310.2, 311.1, 240; 222/185.1, 504

[56] References Cited

U.S. PATENT DOCUMENTS

| | | | |
|---|---|---|---|
| 998,393 | 7/1911 | Reeder | 105/283 |
| 2,774,515 | 12/1956 | Johansson et al. | 105/280 |
| 3,868,913 | 3/1975 | Becker et al. . | |
| 3,902,434 | 9/1975 | Barnard et al. . | |
| 4,009,664 | 3/1977 | Fearon | 105/283 |
| 4,224,877 | 9/1980 | Stark et al. | 105/250 |
| 4,236,458 | 12/1980 | Varda . | |
| 4,250,814 | 2/1981 | Stark et al. . | |
| 4,325,308 | 4/1982 | Erfurth . | |
| 4,329,106 | 5/1982 | Adler | 105/241.2 |
| 4,359,176 | 11/1982 | Johnson . | |
| 4,388,026 | 6/1983 | Green | 406/130 |
| 4,550,665 | 11/1985 | Brouwer | 105/283 |
| 4,580,502 | 4/1986 | Ritzl et al. | 105/240 |
| 4,664,038 | 5/1987 | Davis | 105/308.1 |
| 5,086,709 | 2/1992 | Fischer et al. | 105/282.1 |
| 5,163,372 | 11/1992 | Galvan et al. | 105/240 |
| 5,261,333 | 11/1993 | Miller | 105/287 |
| 5,311,822 | 5/1994 | Bounds | 105/283 |
| 5,359,942 | 11/1994 | Ward | 105/241.2 |
| 5,402,731 | 4/1995 | Miller | 105/284 |
| 5,584,251 | 12/1996 | Lucas | 105/305 |
| 5,606,916 | 3/1997 | Murray | 105/280 |

*Primary Examiner*—S. Joseph Morano
*Attorney, Agent, or Firm*—Baker Botts L.L.P.

[57] ABSTRACT

A single circular or cylindrical door is provided which covers a pair of horizontal discharge openings in a hopper car construction transversely of the longitudinal axis of the rail car. Each circular or cylindrical door is pivotally mounted to the rail car body on each side of the rail car. A fluid operated cylinder is connected to each door at the central span thereof. The other end of the fluid operated cylinder is connected to the center sill of the rail car. A directional valve controls the direction of fluid flow to the fluid operated cylinder to cause the door to rotate from a closed position blocking the pair of discharge openings to an open position whereby both discharge openings may simultaneously discharge material from the hopper car.

36 Claims, 7 Drawing Sheets

AUTOMATED DISCHARGE SYSTEM FOR HOPPER CAR

BACKGROUND OF THE INVENTION

1. Field of the Invention

The present invention relates to a discharge arrangement for discharging materials from storage. More particularly, the present invention relates to a door mechanism allowing selective discharge of materials from railroad hopper cars. Most particularly, the present invention relates to a conversion or new construction for hopper cars having horizontally oriented discharge openings.

2. Description of the Prior Art

Railroad hopper cars are used to transport many types of material including, but not limited to, coal, grain, crushed stone and other loose bulk materials. It is generally customary to fully discharge material from hopper cars into an opening between the railroad tracks by a continuous flow when the hopper doors have been opened.

The use of a discharge arrangement to control the discharge of materials through a bottom outlet in a railroad hopper car is well known. Known discharge arrangements or gate assemblies are disclosed for example in U.S. Pat. Nos. 3,902,434; 4,250,814; and 5,086,709.

The arrangement in the ('434) patent shows a pneumatic motor actuated mechanism to open railroad hopper car doors in which a grooved central member moves vertically between the upper ends of two pivoting swing arms to pull them together or push them apart so as to open or close doors fastened to the lower ends of the swing arms.

The discharge arrangement of the ('814) patent shows a pair of relatively light weight doors which are opened and closed sequentially from an overlapping position by means of a longitudinally extending actuating mechanism moveably supported on the under frame of the car.

The discharge arrangement in the ('709) patent shows a sliding gate structure for controlling discharge of material from openings defined at a lower end of a railroad hopper car. The openings are covered by a pair of gates which linearly move in guide tracks to discharge the material inside or outside of the rails, depending upon which gate is operated.

There have existed problems in the prior art with sliding gate assemblies of the horizontal type such as currently are in wide use in hopper cars primarily used to haul grain. These hopper cars have sliding gates similar to the type shown in the ('709) patent, but they are mounted horizontally, and slide horizontally to close horizontal discharge openings. When used with light weight products such as grain, these gates operate generally satisfactory. However, as pressure developed to use all rail cars more efficiently, it has been desired to have the capability of using the grain hopper cars with other materials such as coal, crushed stones, loose bulk materials, and aggregates for which the car was not originally designed.

It is when gate assemblies originally intended for grain are used with such materials that problems develop. Due to the courser and more abrasive nature of such materials, the gates become difficult to slide. Also when used for coal, aggregates, etc. loose particles of such materials are trapped in the gate slides, and make the operation of the mechanism difficult and erratic. It was in an attempt to solve these problems in existing grain hopper cars that led to the development of the present invention. The solution to the problems in the art have been so successful that the construction disclosed is contemplated as a conversion or original construction for all type of hopper cars.

SUMMARY OF THE INVENTION

The present invention replaces one or more horizontally positioned sliding gates with a single circular, arcuate, or cylindrical door. The door is pivotally mounted at both ends. The door rotates freely in the pivot means. A drive means, which may be pneumatic or hydraulic, is connected to the outer rim of the door. The other end of the cylinder is connected to the rail car. A control means controls the direction of the fluid flow to the cylinders from a source of fluid such as a hydraulic pump or an air reservoir. The opening or closing of the door is regulated by operating the control means either manually, or remotely with an electronic controller. Each door may be operated independently.

In one embodiment of the present invention a well known grain hopper car having six horizontal sliding gate assemblies closing six discharge chutes arranged in three transverse pairs is converted using the construction of the present invention to a construction having three arcuate doors, each of which replaces a pair of laterally positioned sliding gates. Each arcuate door has an associated drive means in the form of a double acting fluid cylinder. Each fluid cylinder is connected to a control means which controls the flow of fluid to the hydraulic cylinders from a source of fluid under pressure.

In another embodiment of the present invention, a new hopper construction is provided having a plurality of pairs of horizontally oriented discharge gates. Each of said plurality of horizontal discharge openings is closed by a single transverse arcuate door. Each arcuate door has a drive means connected thereto, and an associated control means for supplying fluid to the drive means from a source of fluid.

In another embodiment of the present invention, air cylinders are used to operate the arcuate doors. A source of compressed air for operating the cylinders comes from the on board train air supply through a series of additional or auxiliary air lines provided on the hopper cars.

In yet another embodiment of the invention, the fluid cylinders receive air or hydraulic fluid from a track side source of supply.

In still another embodiment of the invention, a single acting air operated cylinder with spring return means is used to operate the arcuate doors.

In still another embodiment of the present invention, a positioning system for remote operation of the hopper doors is provided which may be such as that disclosed in the U.S. Pat. No. 5,359,942 issued Nov. 1, 1994 to Robert J. Ward and assigned to applicant's assignee. The specification of U.S. Pat. No. 5,359,942 is specifically herein incorporated by reference.

Therefore, it is an object of the present invention to provide for an automated discharge system for hopper cars which eliminates the problems previously associated with sliding gate assemblies.

Another object of the present invention is to provide an automated discharge system for hopper cars wherein each discharge door covers a pair of discharge openings such that the time for unloading hopper cars is reduced because the two openings discharge simultaneously.

A further object of the present invention is to provide an automated discharge system for hopper cars whereby the operation of the hopper doors is energized by pneumatic and/or hydraulic power.

A still further object of the present invention is to provide an automated discharge system of the foregoing nature wherein the hopper car doors can be operated either manually or remotely with electronic control.

Further objects and advantages of this invention will be apparent from the following description and appended claims, reference being made to the accompanying drawings forming a part of the specification, wherein like reference, characters designate corresponding parts in the several views.

It is to be understood that the present invention is not limited in its application to the details of construction and arrangement of parts illustrated in the accompanying drawings, since the invention is capable of other embodiments, and is being practiced or carried out in various ways within the scope of the claims. Also, it is to be understood that the phraseology and terminology employed herein is for the purpose of description, and not of limitation.

DESCRIPTION OF THE PREFERRED EMBODIMENT

Figure 1:
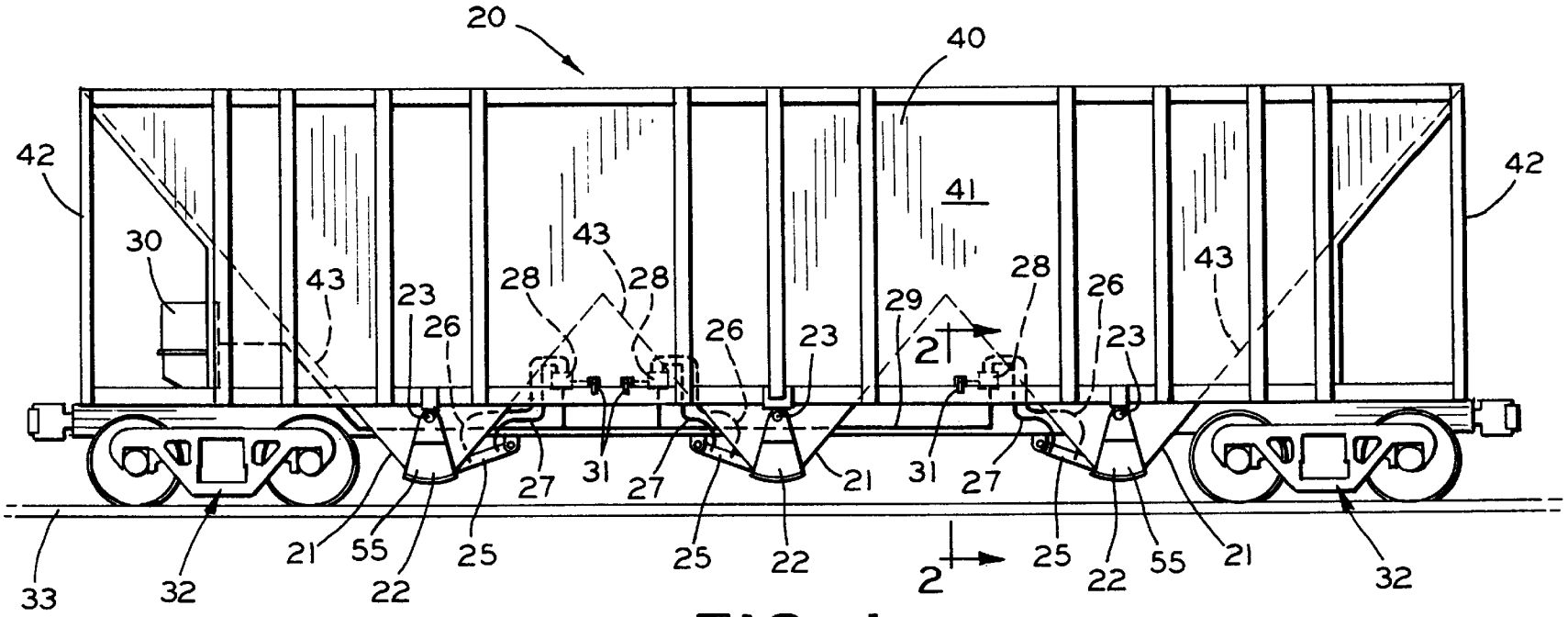
FIG. 1 is a side elevational view, partly diagrammatic in nature, showing a railroad hopper car embodying the construction of the present invention.

Referring to FIG. 1, there is shown a railroad hopper car, generally designated by the numeral 20, having six discharge chutes 21 with horizontal openings. A pair of trucks 32 supports the railway car 20 on a pair of rails 33.

Associated with each discharge chute is a circular or arcuate hopper door 22 which rotates between an open and closed position about pivot point 23 to rotate the hopper door 22 between its open and closed position. Each hopper door 22, which covers the openings in two discharge chutes 21, is associated with a drive means including fluid cylinder 25. Each fluid cylinder 25 is connected by a first conduit 26 and a second conduit 27 to a control means which may include directional valve 28. A source of fluid is supplied to each of the directional valves 28 by third conduit 29. Third conduit 29 is connected to a source of fluid 30. Source of fluid 30 may be an air operated hydraulic pump, an air reservoir, a hydraulic reservoir, a remote control positioning system as disclosed in the aforementioned U.S. Pat. No. 5,359,942, or any source of fluid of types well known in the art.

The fluid coming from the source of fluid 30 through the third conduit 29 to the directional valve 28 is directed to either first conduit 26, or second conduit 27 by handle 31 connected to directional valve 28 to open or close the hopper door 22. The handle 31 extends through to both sides of the car so that the hopper doors may be operated from either side.

Referring now to FIGS. 1–4, the construction and operation of a first embodiment of the present invention may be understood. The hopper car 20 includes car body 40, which is defined by spaced side walls 41 which join end walls 42. Internal walls 43, and side walls 41 determine the load carrying space in the car body 40. The internal walls 43 slope downwardly and terminate to form discharge openings or discharge chutes 21.

Figure 2:
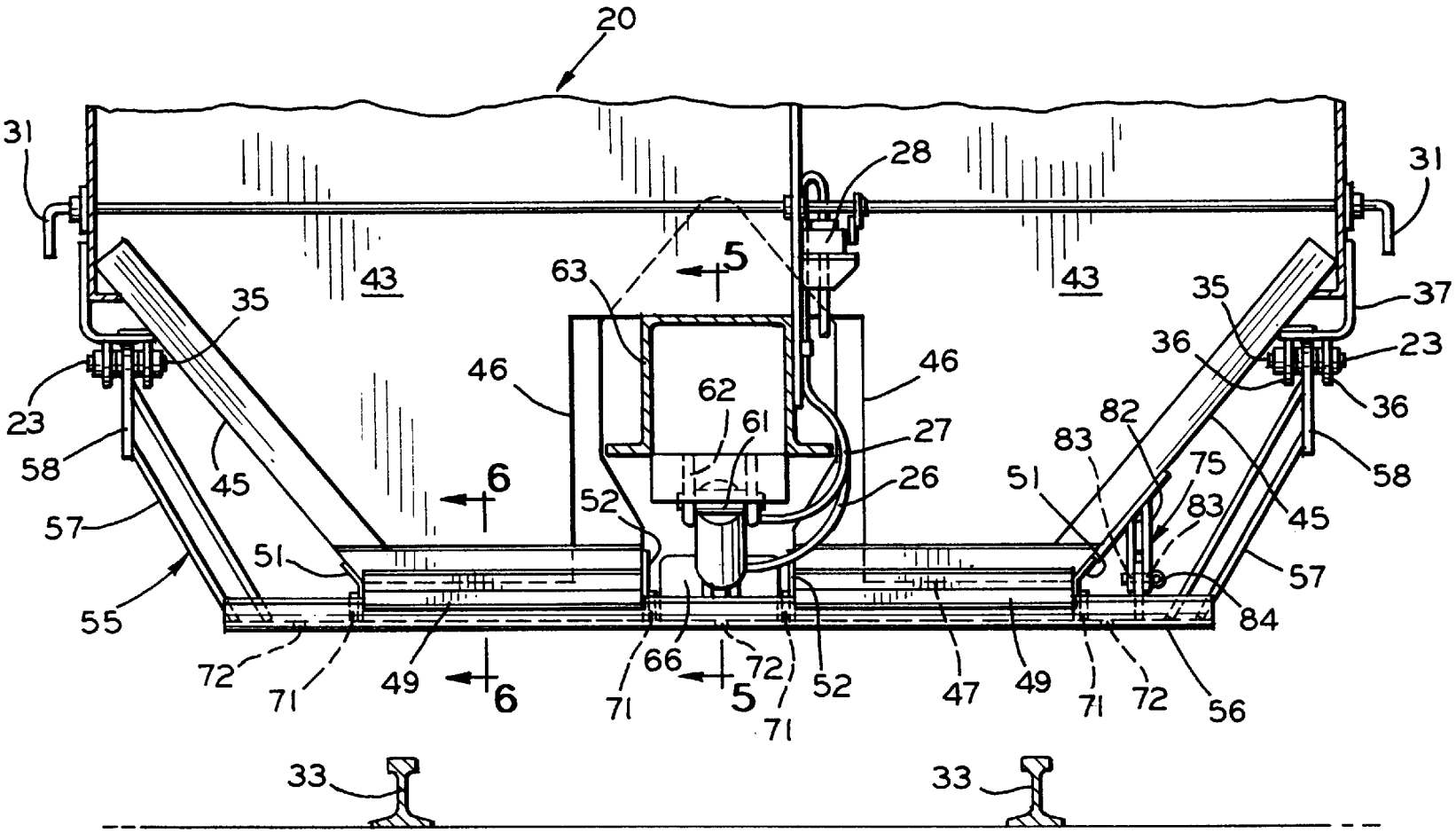
FIG. 2 is a sectional view, taken in the direction of the arrows, along the section line 2—2 of FIG. 1.
Figure 3:
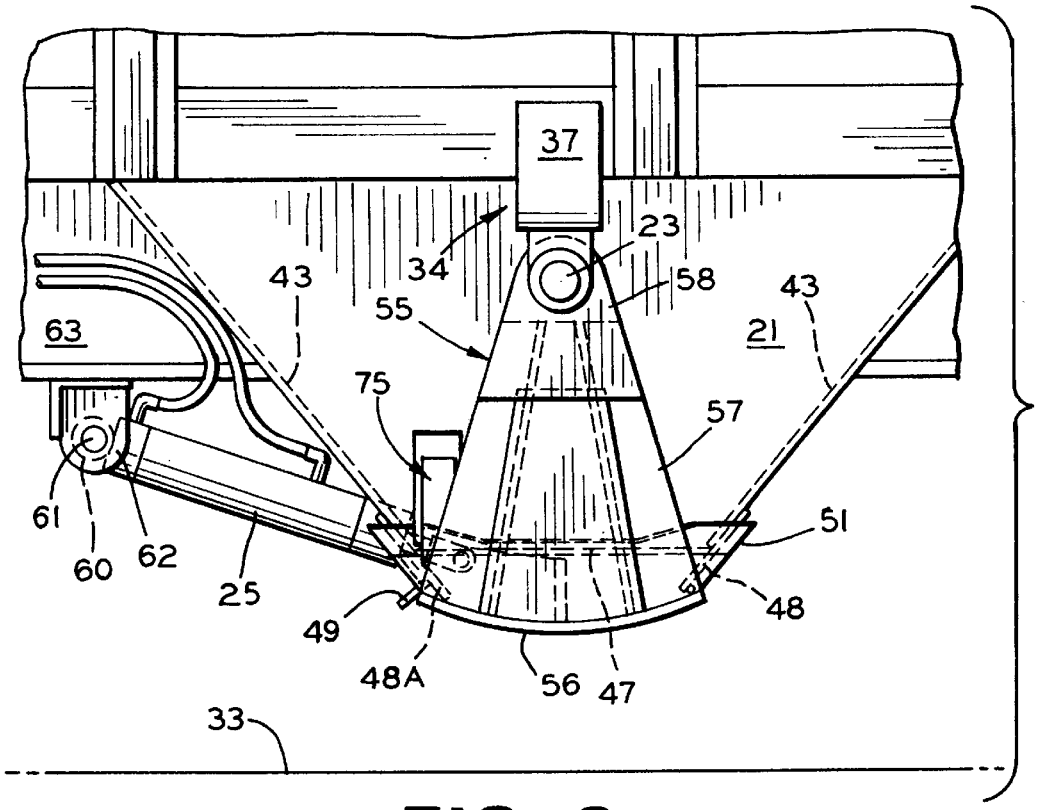
FIG. 3 is a fragmentary elevational view showing a hopper discharge chute with the improved hopper door construction of the present invention shown in its closed position.
Figure 4:
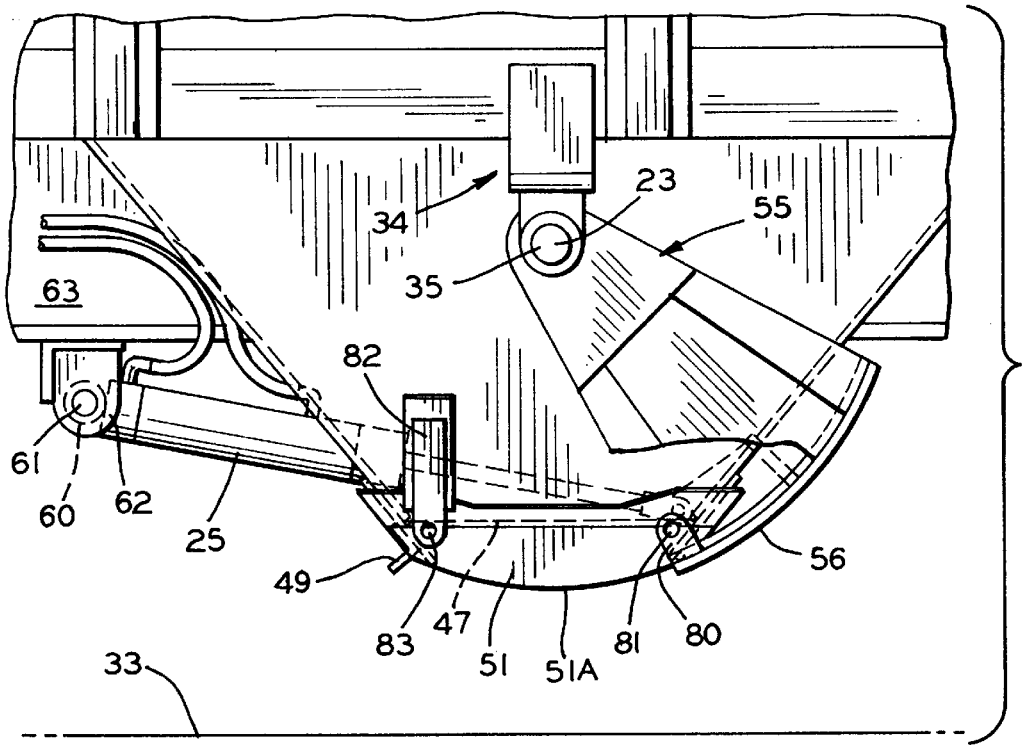
FIG. 4 is view similar in part to FIG. 3, but showing the hopper door in its open position.
Figure 5:
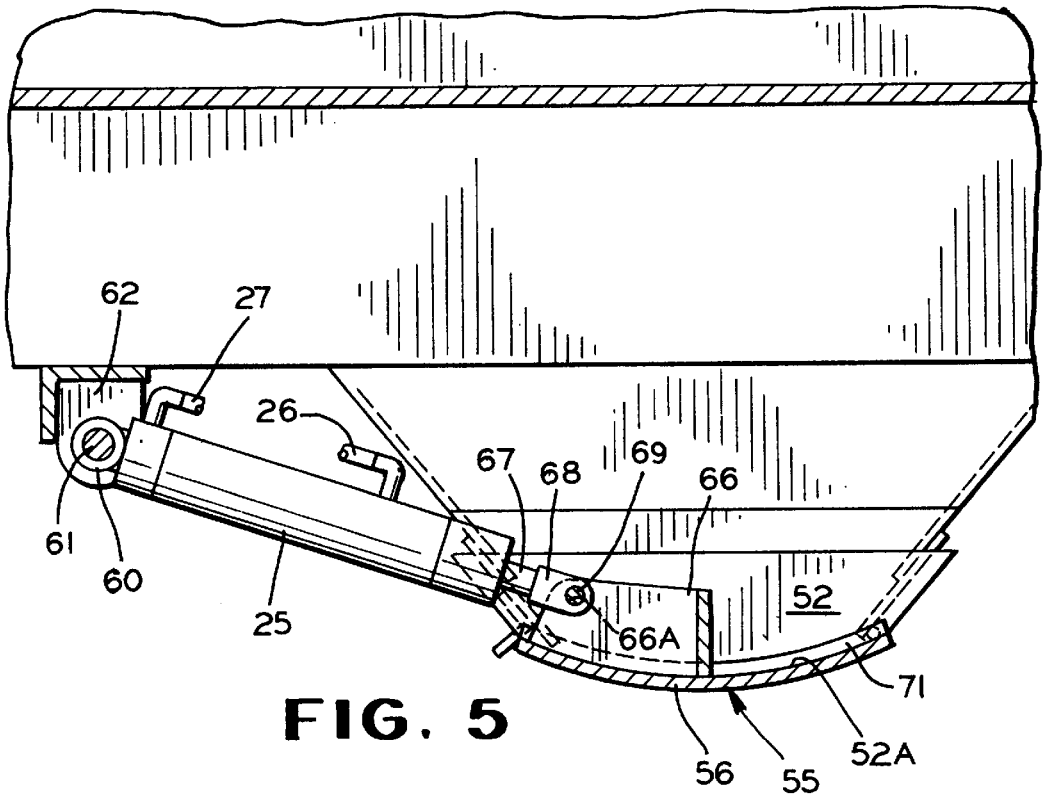
FIG. 5 is a sectional view, taken in the direction of the arrows, along the section line 5—5 of FIG. 2.

Referring now to FIG. 2, (one of the internal walls 43 and the car trucks 32 have been deleted for clarity) each discharge chute 21 is formed by a pair of opposed sloping internal walls 43, an outer sloped side wall 45, and an inner vertical wall 46. The lower edges of the pair of opposed internal walls 43, outer sloped side wall 45, and inner vertical side wall 46 form horizontal discharge opening 47, which is generally rectangular in shape. It can be understood by those skilled in the art that the horizontal discharge opening 47 may either that formed in a new hopper car construction prior to the application of the present invention or that discharge opening left in a rail car conversion after the horizontal sliding gates found in the prior art hopper cars have been removed.

According to the present invention it is desired to replace the horizontal sliding gates with a pivoting circular or cylindrical door 55. Each such door 55 will have a circular or arcuate plate or portion 56, in the form of a portion of a lateral surface of a cylinder, spanning a pair of horizontal discharge openings 47. Each circular plate 56 will be supported by a pair of end plates or portions 57 which pivot about the pivot point 23. The pivot point 23 is selected using several considerations, and its application in each hopper car may vary. The first consideration is choosing the pivot point such that the hopper door 55 will achieve its maximum opening before hitting the center sill of the car.

A second consideration in choosing the pivot point is the rail clearance needed by the particular hopper car.

A third consideration will be to achieve the maximum opening of the door given the drive means that is to be used and the particular embodiment of the invention.

Once the position of the pivot point is chosen the door 55 is mounted to the body 40 of the rail car through appropriate pivot means 34. Such pivot means may include a mounting or reinforcement portion 58 being provided on the end plates 57 with a journal being provided in which is carried a pivot shaft 35. Pivot shaft 35 may in turn be carried by journals 36 on pivot bracket 37 mounted to the rail car body 40.

Since the circular doors 55 are mounted to pivot points 23 based on the above enumerated considerations the cylindrical or curved portions 56 will be a predetermined distance from the horizontal discharge openings 47 after the doors 55 are mounted to the rail cars. In order to close the gap between the horizontal discharge opening 47 and provide a seal with the arcuate portion 56 of the doors 55 a discharge chute frame 50 is now applied proximate the horizontal discharge opening 47.

The discharge chute frame 50 will have an inlet portion aligned with the discharge opening 47 and an outlet portion aligned with the cylindrical door 55. The chute frame may be preassembled and attached to the discharge chute 21, or formed in place. In the preferred embodiment, as described below, the chute may be formed in place. The outlet of the chute frame will have a generally rectangular perimeter complemental in shape to the cylindrical door 56. The discharge frame will consist of a forward extension member 48A and a rear extension member 48B, both having straight lower edges, attached to the opposed sloping side walls 43, in such a manner that the straight lower edges just barely clear interior surface 56A of cylindrical door 55. In a like manner, after the forward and rear extension members (48A, 48B) are attached, an outer slanted wall 51 and an inner vertical wall piece 52 are attached. Lower edges 51A, 52A of the outer slanted wall 51 and the inner vertical wall 52 respectively are curvilinear or arcuate in nature and are fastened in place so that the lower edges just barely clear the interior surface 56A of the curved portion 56 of the circular doors 55. The lower edges (48A, 48B, 51A and 52B) thus form a complemental cylindrical surface outlining a portion of a lateral surface of a cylinder. Thus, the door 55 may rotate into and out of it closed position with virtually no friction. The large frictional forces acting on the prior art horizontal doors have been replaced by the relatively low friction of the pivot means 34.

Figure 6:
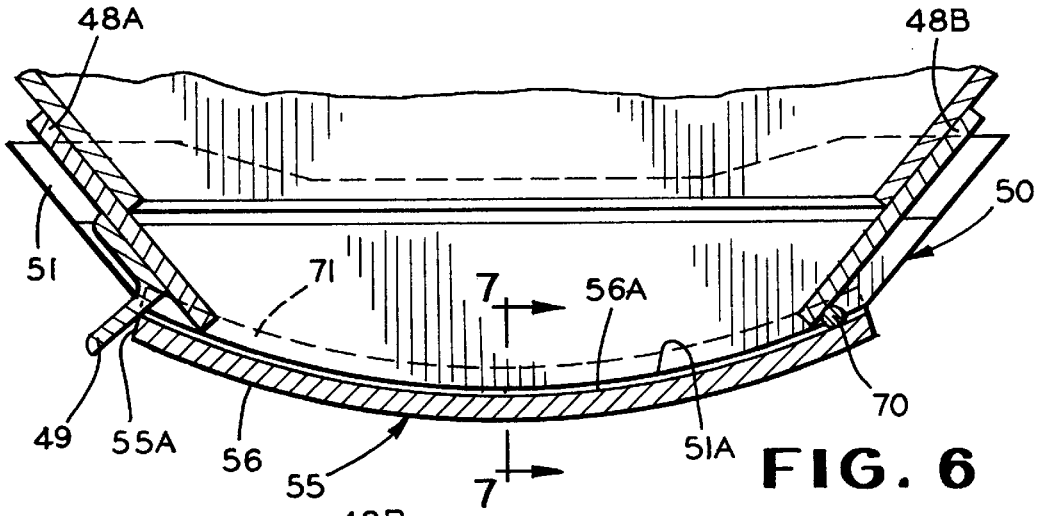
FIG. 6 is a sectional view, taken in the direction of the arrows, along the section line 6—6 of FIG. 2.
Figure 7:
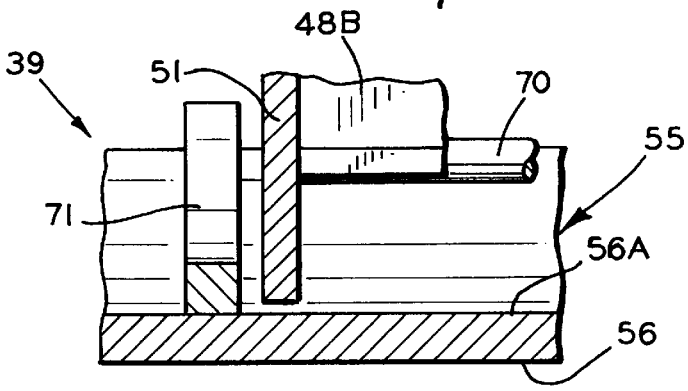
FIG. 7 is a sectional view, taken in the direction of the arrows, along the section line 7—7 of FIG. 6.
Figure 8:
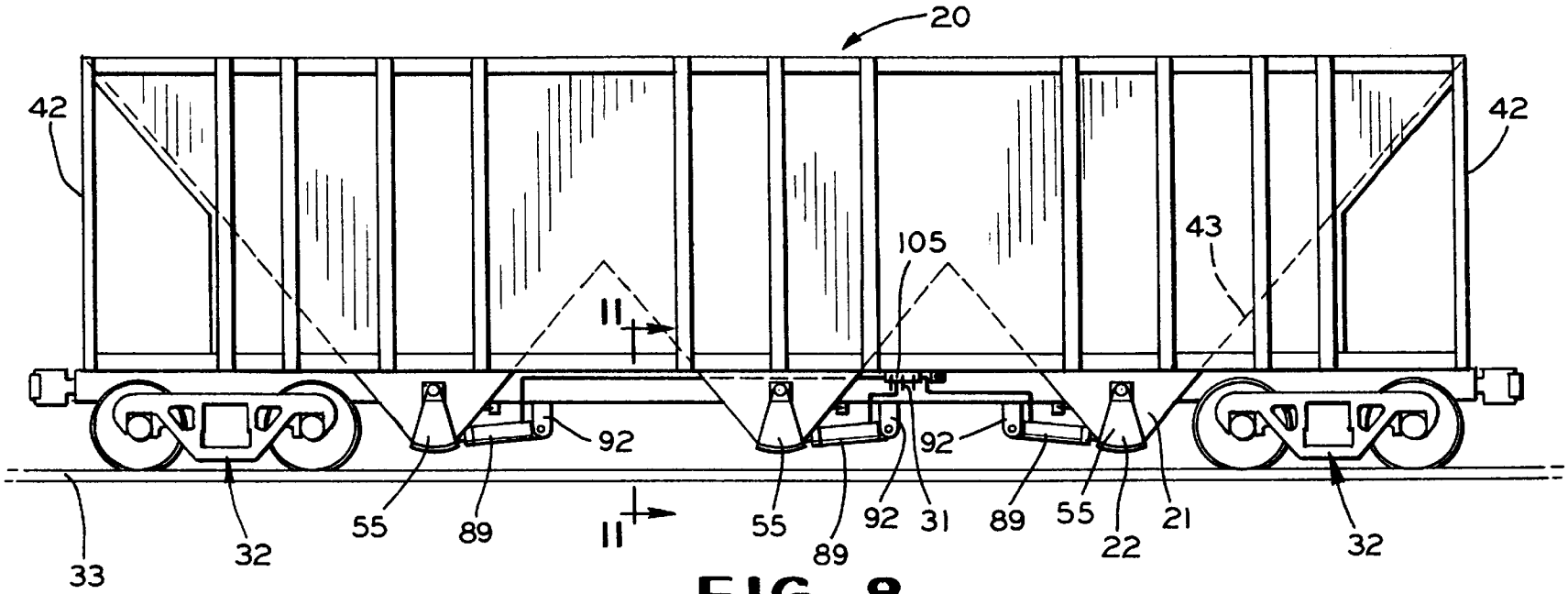
FIG. 8 is a side elevational view, partly diagrammatic in nature, showing a railroad hopper car embodying a modification of the present invention.

In order that the hopper car using the improved construction of the present invention does not lose any material out the bottom of the discharge chutes 21, sealing means 39 are provided. Said sealing means may be provided in the form of a labyrinth seal. Referring to FIGS. 6 and 7, such sealing means are provided by attaching a rod 70 to the upper surface 56A of the circular or arcuate portion 56 of the circular door 55 in a position such that the rod 70 just abuts the rear extension member 48B when the forward edge 55A of the circular door 55 abuts the stop means 49. Since the circular portion 56 of the circular door 55 extends past the front and rear extension members (48A, 48B) it is not likely that much material will get past the extension members. Whatever does get past the extension members is stopped by the stop means 49 and the rod 70 as far as the front and the rear of the discharge chutes 21 are concerned.

To prevent material from laterally leaving the discharge chutes 21, a plurality of door guides 71 are mounted to the upper surface 56A of the circular portion 56 of the circular door 55. Each door guide 71 is mounted in close proximity to either the outer slanted wall 51 or the inner vertical wall 52. Any material that may get past the outer slanted wall 51 or the inner vertical wall 52 is stopped by the door guide 71. The door guide 71 also performs the function of preventing water which may gather in the central or outer portions of the door 55 when the hopper car 20 is operated in inclement weather from contaminating the material contained in the discharge chutes 21. To minimize any problems, drain holes 72 may be provided.

In order to cause the circular door 55 to open and close, a fluid operated cylinder 25 is used. Each fluid cylinder 25 has attached thereto a bearing block 60 in which is rotatably engaged shaft 61 which is carried in bracket 62 which is attached to the center sill 63 of the railway car.

To the center of each circular portion 56 of circular door 55 is attached a mounting bracket 66. Fluid cylinder 25 has a shaft 67 connected to a yoke 68. Yoke 68 is operatively connected to second shaft 69, which is held in journal 66A of bracket 66. It can be seen that as the shaft 67 expands and retracts in response to fluid entering the cylinder 25 through second conduit 27 or first conduit 26 the circular door 55 moves into and out of its closed position.

In order to prevent accidental opening of the circular doors 55, a locking means 75 may be provided adjacent each door. Each door 56 will have a bracket 80 having hole 81 therein attached proximate an edge of the door. A yoke 82 will be attached to the outer sloped side wall 45 of the railway car 20. Yoke 82 will have a pair of axially aligned holes 83 therein. A pin 84 or other locking means may be inserted through the holes 81, 83 when the bracket 80 and yoke 82 are in their aligned position.

Referring now to FIGS. 8–11, an embodiment of the present invention using air operated fluid cylinders in place of the hydraulically operated fluid cylinders described in connection with the previous FIGS. 1–7 is shown. The construction is largely identical except for the replacement of the hydraulic fluid cylinder 25 with an air operated cylinder, and the addition of spring return means. Thus, since the construction of the railway car 20, the discharge chute frame 50, and the circular door 55 remains identical to that previously described, details of these drawings have been omitted for clarity in FIGS. 8–11. Only the differences in construction will be identified.

The circular door 55 is constructed substantially as before. A circular or arcuate portion 56 is attached to sloped side wall portions 57. Because the pneumatically operated version of the present invention is normally used in connection with lighter materials and therefore less force is needed to open and close the circular door 55, the separate mounting portions 58 thereof are omitted. For clearance purposes, a central portion 90 of circular portion 56 is cutaway. Pneumatic cylinder mounting bracket 91 replaces the mounting bracket 66. An elongated bracket 92 replaces bracket 62. As before, the pneumatic cylinder 89 has a bearing block 94. Shaft 95 rotates in bearing block 94. Shaft 95 is constrained by elongated bracket 92 to secure one end of the pneumatic cylinder. The other end of the pneumatic cylinder 89 has moveable shaft 96 which has yoke 97 fixedly connected to the end thereof. Pin 98 connects the yoke 97 to the pneumatic cylinder mounting bracket 91.

The pneumatic cylinder 89, in contrast to the hydraulic or fluid cylinder 25, acts in one direction only and, thus, needs a spring return means to return the circular door 55 to its closed position. The spring means may include such as a spring bracket 100 attached to the central portion of the circular door 55, and a retaining bracket 101 attached to the center sill 63 of the hopper car 20. A eye bolt assembly 102 fastens one end of the spring 103 to the retaining bracket 101. The other end of the spring 103 is retained by the mounting hole 104 in the spring bracket 100.

The handles 31 are now connected to a single acting valve 105 of the type well known in the art to operate the pneumatic cylinders 89. As before, each pneumatic cylinder may be operated independently from either side of the railroad hopper car 20. Air may be supplied to the single acting valve from an onboard source of air such as an air operated compressor, an auxiliary air line, or a track side air source, as with the hydraulic embodiment of the present invention.

Regardless of how the fluid cylinders 25 are activated, the source of fluid may be provided in several ways. Reference has already been made to FIG. 1 wherein the source of fluid 30 was a remote control unit having an air operated hydraulic pump, or simply an air operated hydraulic pump.

Figure 12:
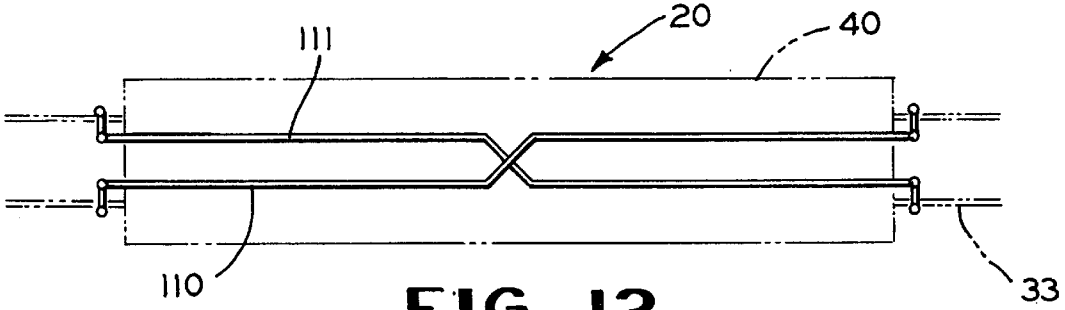
FIG. 12 is a plan view of a railroad car showing how an auxiliary air line maybe be provided in addition to the normal brake pipe found on railroad cars.

Referring to FIG. 12, there is shown a diagrammatic view of a typical hopper car 20 with the car body 40 shown in phantom lines. The normal brake pipe which supplies air for the braking of the train has been indicated at 110. Other details of the braking system, such as the air reservoir, brake cylinder, and ABD valve have been omitted for clarity. Since current Federal Railway Administration Regulations do not permit taking any auxiliary air supply off of the brake pipe 110, a separate auxiliary air line 111 may be provided on the under side of the railroad hopper car 20, and air taken from the auxiliary air line to operate the fluid cylinders 25. The auxiliary air line 111 may be a mirror image of the brake pipe 110 to prevent cross connections between the two, or it may be of any other configuration permitted by Federal Railway Administration Regulations.

Figure 13:
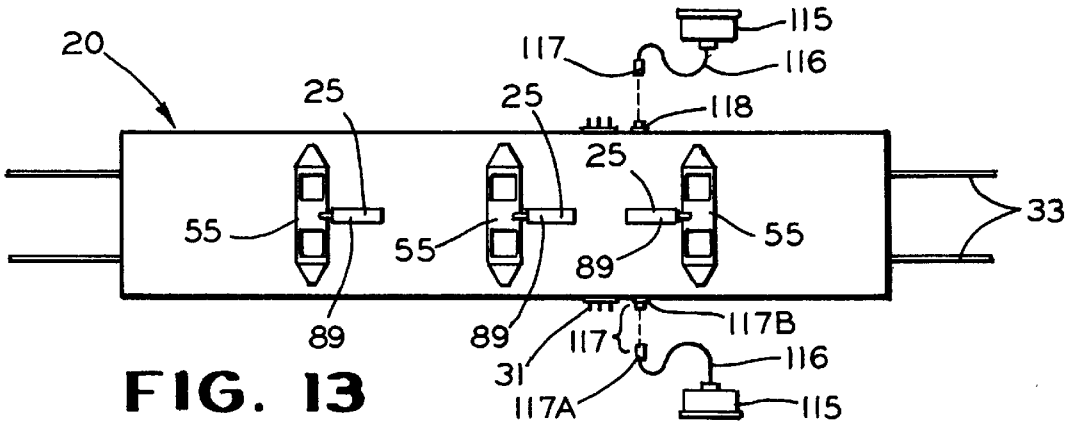
FIG. 13 is a diagrammatic view showing how a track side source of fluid power may be connected to a rail car embodying the present invention to operate the fluid cylinders.
Figure 9:
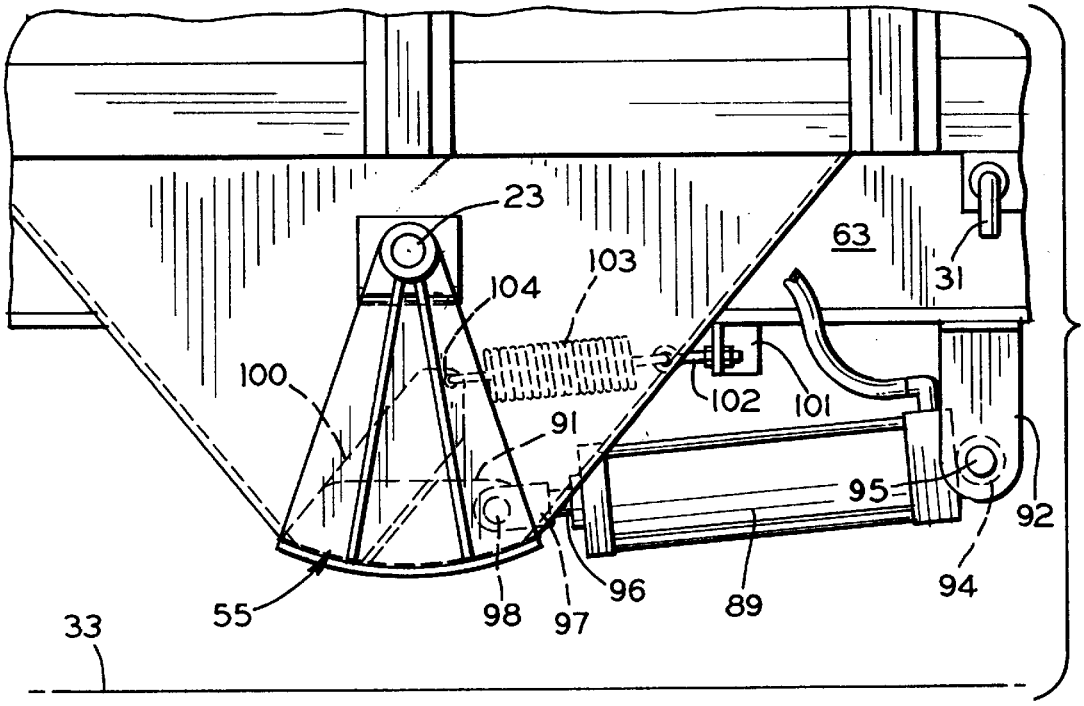
FIG. 9 is a fragmentary view on an enlarged scale showing one of the hopper doors of the construction shown in FIG. 8 in a closed position covering the horizontal discharge opening of the hopper car.
Figure 10:
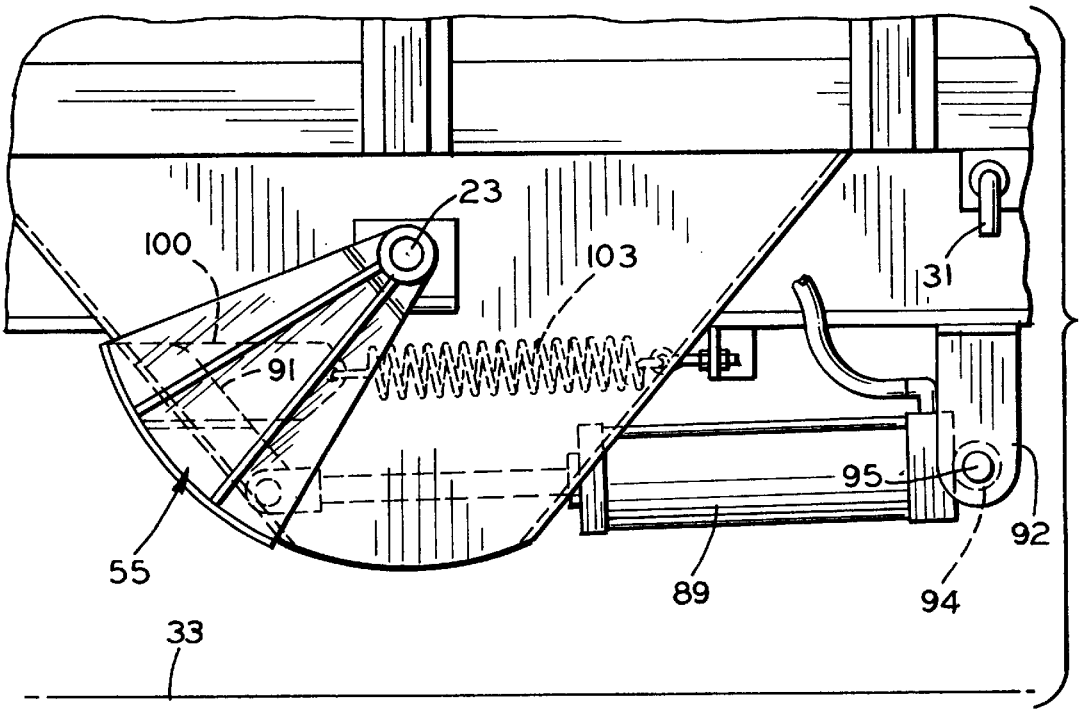
FIG. 10 is a view similar in large part to FIG. 9 but showing the hopper door in its open position.
Figure 11:
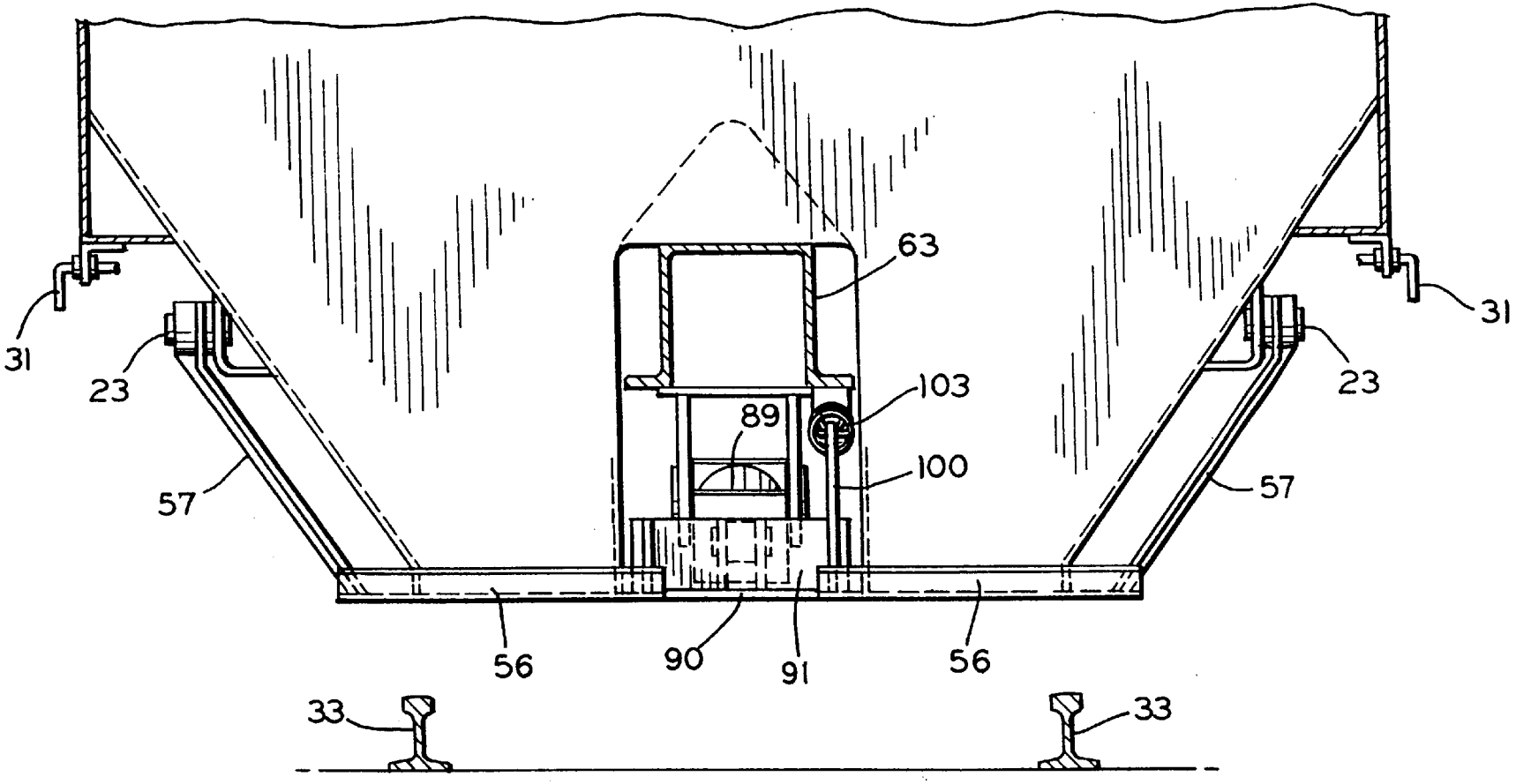
FIG. 11 is a sectional view, taken in the direction of the arrows, along the section line 11—11 of FIG. 8.

Referring to FIG. 13, another source of fluid is shown. A track side source 115 may be placed on one or both sides of the rails 33. The track side source 115 may supply hydraulic fluid and/or pneumatic fluid or air under pressure depending upon which embodiment of the invention is being used in the railroad hopper car 20. Track side source 115 is connected through flexible conduit 116 to a quick connect 117. First portion 117A connects to second portion 117B (mounted to car 20) of the quick disconnect 117 to complete the fluid connection between the track side source 115 and the railroad hopper car 20. Handles 31 again direct the operation of the fluid cylinders 25, which in this case are the pneumatically operated cylinders 89. The track side source 115 of fluid is particularly advantageous where the particular hopper cars having the embodiment of the invention are normally unloaded at a conveniently located terminal site, rather than at remote locations.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A railway hopper car comprising:

a rail car body having at least one horizontal discharge opening;

at least one circular door pivotally mounted to said rail car body below said at least one horizontal discharge opening to selectively open or close said discharge opening;

a fluid cylinder connected to each of said at least one circular door to selectively move said door between an open and closed position;

a control means connected to said fluid cylinder for controlling said fluid cylinder and the positioning of said door; and said fluid cylinder pivotally connected to said circular door, said fluid cylinder having a first end pivotally connected to a central span of said circular door and a second end pivotally connected to a center sill of said railway hopper car.

2. The railway hopper car defined in claim 1, wherein said at least one circular door is formed by an arcuate plate mounted between two door end plates.

3. The railway hopper car defined in claim 2, wherein each of said door end plates has a mounting portion fixedly attached thereto.

4. The railway hopper car defined in claim 3, wherein each of said mounting portions of said end plates has a journal formed therein.

5. A railway hopper car comprising:

a rail car body having at least one horizontal discharge opening;

at least one circular door pivotally connected to said rail car body below said at least one horizontal discharge opening to selectively open or close said discharge opening;

a fluid cylinder connected to said at least one circular door to selectively move said door between an open and closed position;

a control means connected to said fluid cylinder for controlling said fluid cylinder and the position of said door; and a chute frame interposed between each of said at least one horizontal discharge opening and said circular door, said chute frame including:

a forward extension member;

a rearward extension member;

an outer slanted wall portion; and an inner vertical wall portion, said forward extension member, rear extension member, outer slanted wall portion, and inner vertical wall portion being attached to said railway hopper car proximate each of said horizontal discharge openings to provide an inlet proximate said horizontal discharge opening and an outlet having a complemental cylindrical surface at a predetermined distance below said horizontal discharge opening.

6. The railway hopper car defined in claim 1, wherein said fluid cylinder comprises a hydraulic cylinder.

7. The railway hopper car defined in claim 1, wherein said fluid cylinder comprises a pneumatic cylinder.

8. The railway hopper car defined in claim 1, wherein said control means comprises a remote control system.

9. The railway hopper car defined in claim 1 and including a locking means for locking said at least one circular door in a closed position.

10. A railway hopper car comprising:

a rail car body having at last one horizontal discharge opening;

at least one circular door pivotally connected to said rail car body below said at least one horizontal discharge opening to selectively open or close said discharge opening;

a fluid cylinder connected to said at least one circular door to selectively move said door between an open and closed position;

a control means connected to said fluid cylinder for controlling said fluid cylinder and the position of said door; and a double acting fluid cylinder having a first conduit and a second conduit connected thereto;

a directional valve in fluid communication with said first conduit and said second conduit; and a source of fluid under pressure connected to said double acting valve.

11. The railway hopper car defined in claim 10, wherein said source of fluid pressure comprises an air operated hydraulic pump connected to an auxiliary air line mounted to said hopper car.

12. The railway hopper car defined in claim 10, wherein said source of fluid under pressure is a track side source of fluid pressure.

13. A railway hopper car comprising:

a) a car body having a longitudinal axis and at least one pair of horizontal discharge openings aligned transversely of said longitudinal axis;

b) a chute frame mounted to said car body proximate each of said at least one pair of horizontal discharge openings to provide a pair of laterally aligned complemental cylindrical surfaces proximate to and below each of said at least one pair of horizontal discharge openings;

c) the chute frame having a forward extension member, a rear extension member, an outer slanted wall portion and an inner vertical wall portion, said forward extension member, rear extension member, outer slanted wall portion, and inner vertical wall portion being attached to said railway hopper car proximate each of said horizontal discharge openings to provide an inlet proximate said horizontal discharge opening and an outlet having the complemental cylindrical surfaces at a predetermined distance below said horizontal discharge opening;

d) at least one circular door pivotally mounted to said car body to pivot into and out of close proximity to each of said pair of complemental cylindrical surfaces of said chute frames thereby selectively opening or closing each of said pair of horizontal discharge openings simultaneously;

e) drive means connected to each of said at least one circular door to selectively move said door between an open and closed position; and f) a control means connected to said drive means for controlling the drive means and the positioning of said door.

14. The railway hopper car defined in claim 13, wherein said at least one circular door is formed by an arcuate plate mounted between two door end plates.

15. The railway hopper car defined in claim 14, wherein each of said door end plates has a mounting portion fixedly attached thereto.

16. The railway hopper car defined in claim 15, wherein each of said mounting portions of said end plates has a journal formed therein.

17. The railway hopper car defined in claim 13, wherein said drive means comprises a fluid cylinder pivotally connected to said at least one circular door, said fluid cylinder having a first end pivotally connected to a central span of said at least one circular door and a second end pivotally connected to a center sill of said railway hopper car.

18. The railway hopper car defined in claim 17, wherein said fluid cylinder is a pneumatic cylinder.

19. The railway hopper car defined in claim 17, wherein said control means comprises a remote control system.

20. The railway hopper car defined in claim 14, wherein said drive means comprises:

a) a double acting fluid cylinder having a first conduit and a second conduit connected thereto;

b) a directional valve in fluid communication with said first conduit and said second conduit; and c) a source fluid under pressure connected to said double acting valve.

21. The railway hopper car defined in claim 20, wherein said fluid cylinder is a hydraulic cylinder.

22. The railway hopper car defined in claim 21, wherein said source of fluid under pressure comprises an air operated hydraulic pump connected to an auxiliary air line mounted to said hopper car.

23. The railway hopper car defined in claim 21, wherein said source of fluid under pressure is a track side source of fluid pressure.

24. The railway hopper car defined in claim 13 further comprising a locking means for locking said at least one circular door in a closed position.

25. A discharge chute assembly for a railway hopper car having at least one horizontal discharge opening, said discharge chute assembly comprising:

a chute frame adapted to be mounted to said railway hopper car proximate the horizontal discharge opening to provide a cylindrical closure surface proximate to and below said horizontal discharge opening;

a circular door pivotally adapted to be mounted to said railway car below said chute frame to pivot into and out of close proximity to said cylindrical closure surface to thereby selectively open or close said horizontal discharge opening;

a fluid cylinder connected to said circular door to selectively move said door between an open and closed position;

a control means connected to said fluid cylinder for controlling said fluid cylinder and the positioning of said door; and said fluid cylinder pivotally connected to a central span of said circular door and a second end adapted to be pivotally connected to a center sill of said hopper car.

26. The discharge chute assembly defined in claim 25, wherein said circular door is formed by an arcuate plate mounted between two door end plates.

27. The discharge chute assembly defined in claim 26, wherein each of said door end plates has a mounting portion fixedly attached thereto.

28. The discharge chute assembly defined in claim 27, wherein each of said mounting portions of said end plates has a journal formed therein.

29. The discharge chute assembly defined in claim 26, wherein said chute frame includes:

a) a forward extension member;

b) a rear extension member;

c) an outer slanted wall portion; and d) an inner vertical wall portion, said forward extension member, rear extension member, outer slanted wall portion, and inner vertical wall portion being attached to said railway car proximate said horizontal discharge opening to provide an inlet proximate said horizontal discharge opening and an outlet having the complemental cylindrical surfaces at a predetermined distance below said horizontal discharge opening.

30. The discharge chute assembly defined in claim 25, wherein said fluid cylinder comprises:

a) a double acting fluid cylinder having a first conduit and a second conduit connected thereto;

b) a directional valve in fluid communication with said first conduit and said second conduit; and c) a source fluid under pressure connected to said double acting valve.

31. The discharge chute assembly defined in claim 25, wherein said fluid cylinder is a hydraulic cylinder.

32. The discharge chute assembly defined in claim 25, wherein said fluid cylinder comprises a pneumatic cylinder.

33. The discharge chute assembly defined in claim 25, wherein said control means includes a remote control system.

34. The discharge chute assembly defined in claim 31, wherein said source of fluid under pressure an air operated hydraulic pump connected to an auxiliary air line mounted to said hopper car.

35. The discharge chute assembly defined in claim 31, wherein said source of fluid under pressure comprises a track side source of fluid pressure.

36. The discharge chute assembly defined in claim 25 further comprising a locking means for locking said circular door in a closed position.

* * * * *